United States Patent [19]

Lovis

[11] 4,405,166

[45] Sep. 20, 1983

[54] ENERGY SAVING WINDOW LOCK

[76] Inventor: Luis H. Lovis, 2002 Briscoe Ave., Artesia, N. Mex. 88210

[21] Appl. No.: 255,108

[22] Filed: Apr. 17, 1981

[51] Int. Cl.[3] ..... E05C 17/20

[52] U.S. Cl. ..... 292/305

[58] Field of Search ..... 292/305, 306, 277, 278, 292/266, 267, 338, 339

[56] References Cited

U.S. PATENT DOCUMENTS

| | | | |
|---|---|---|---|
| 242,281 | 5/1881 | Debacher | 292/175 |
| 392,030 | 10/1888 | Hodgkins | 292/305 |
| 703,252 | 6/1902 | Hamilton | 292/305 |
| 1,095,714 | 5/1914 | Depper | 292/305 |
| 1,397,450 | 11/1921 | Penny | 292/305 |
| 1,851,701 | 3/1932 | Goll | 292/305 |
| 3,608,940 | 9/1971 | Mueller | 292/305 |
| 4,005,889 | 2/1977 | Patrick | 292/305 X |

*Primary Examiner*—Richard E. Moore

[57] ABSTRACT

This energy saving and burglar proof lock enables windows to be adjustably opened to about six inches, at night, for allowing fresh air to circulate throughout a dwelling, thus allowing the air conditioner to be turned off, and it further serves to prevent anyone from entering the windows. It includes a pair of plates, one of which is secured to the window frame, and the other is secured to the bottom window. It further includes an indented or toothed rod, welded to one of the plates, and slidably received in the other, the rod being held secured by a spring-urged pin.

6 Claims, 10 Drawing Figures

FIG. 1
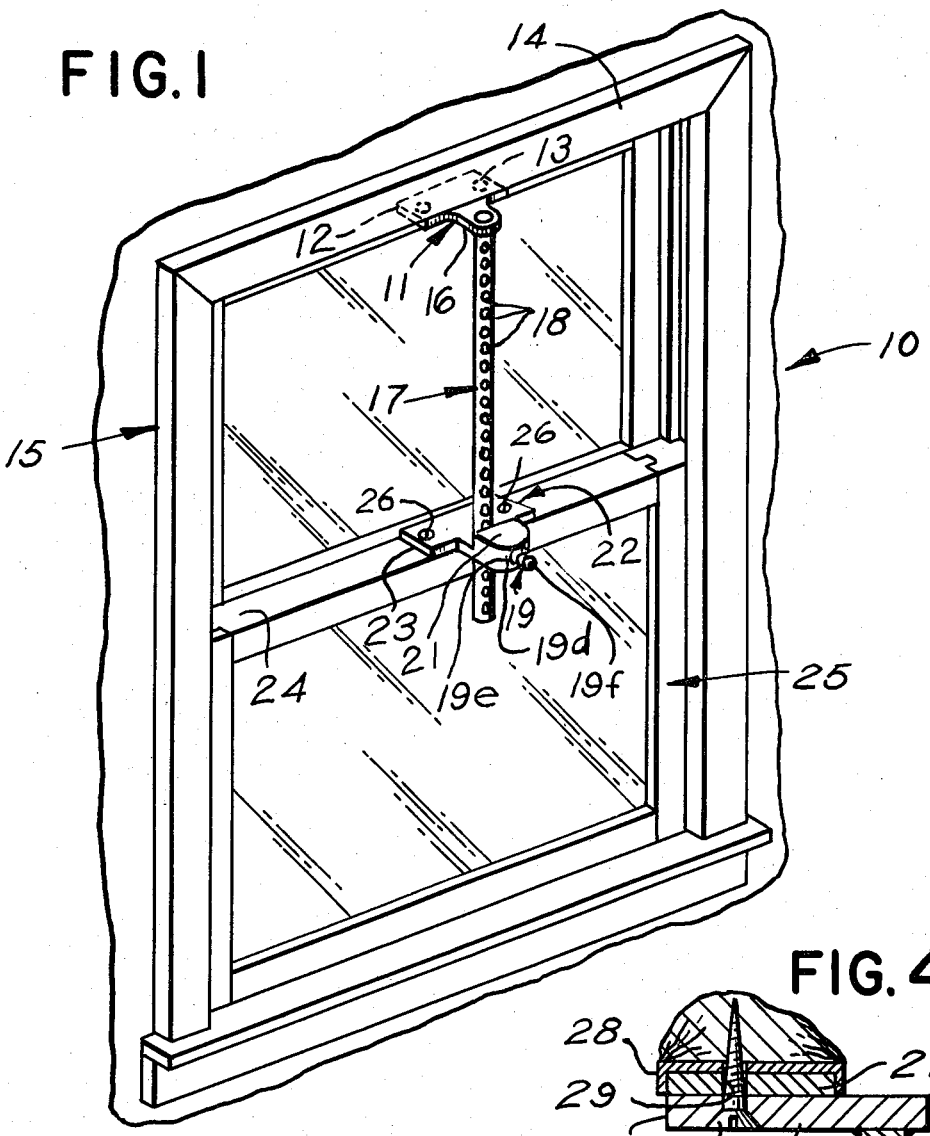
FIG. 4
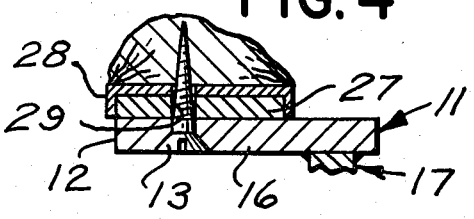
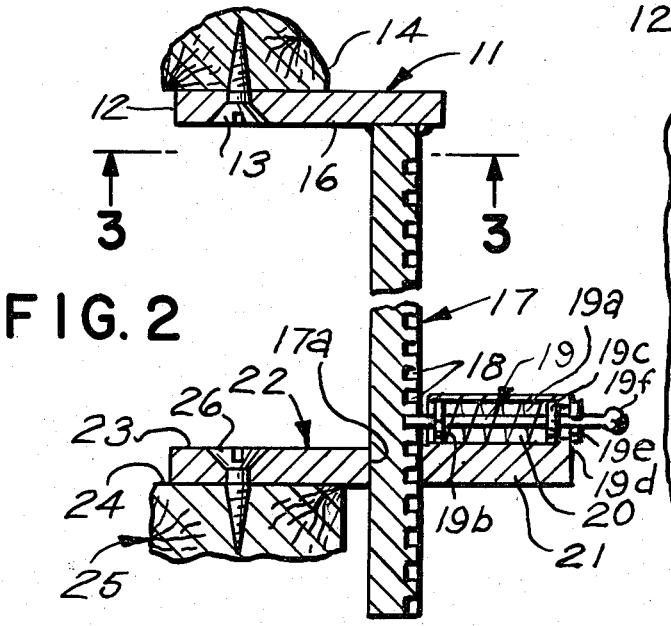
FIG. 2
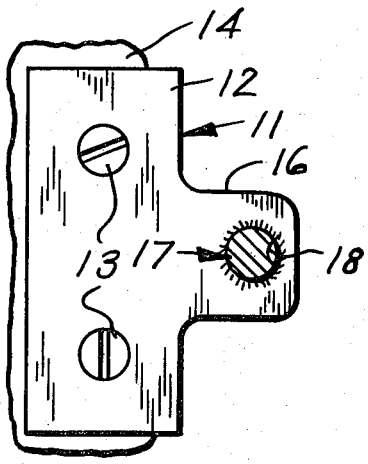
FIG. 3

ENERGY SAVING WINDOW LOCK

This invention relates to window devices, and more particularly, to a window lock.

It is, therefore, the principal object of this invention to provide a window lock, which will be adjustable, to retain a bottom window at any desired elevation, so as to allow fresh air to circulate throughout a room, particularly at night, so as to enable the user to turn off his air conditioner, thus saving money and energy.

Another object of this invention is to provide a window lock, which will serve as security means, against the entry of burglars through a window.

Another object of this invention is to provide a window lock, which will include a pair of plates with rod means, and a spring-urged pin, for setting the bottom window at any desired elevation.

A further object of this invention is to provide a window lock, which will be of such structure, that it will enable older windows, that fall, to stay up at any desirable elevation.

An even further object of this invention is to provide a window lock, which will be easily modified to be adaptable to metal windows.

Other objects of the present invention are to provide an energy saving window lock, which is simple in design, inexpensive to manufacture, rugged in construction, easy to use and efficient in operation.

These, and other objects, will be readily evident, upon a study of the following specification, and the accompanying drawings, wherein:

FIG. 1 is a perspective view of the present invention, shown installed;

FIG. 2 is an enlarged fragmentary side elevational view of FIG. 1, shown in cross-section;

FIG. 3 is a cross-sectional view, taken along the line 3—3 of FIG. 2;

FIG. 4 is an enlarged fragmentary side elevational view, similar to FIG. 2, but showing a modified form of the top portion, for adaptation to aluminum or other metal windows;

Figure 5:
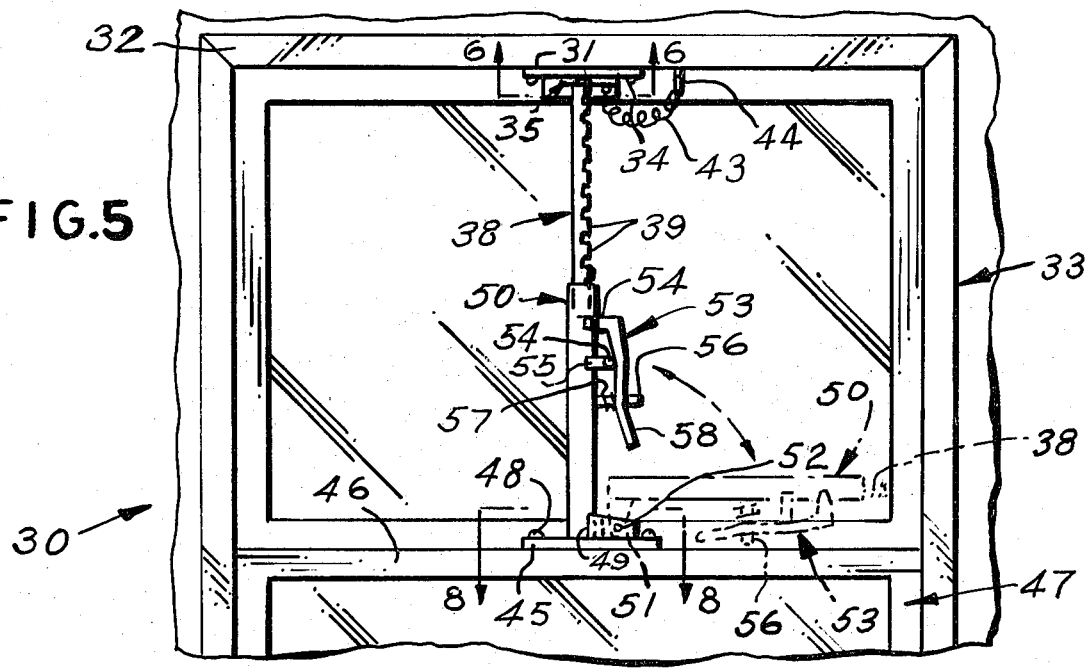
FIG. 5 is a fragmentary inside face view of a window, showing a modified form of the invention installed.
Figure 6:
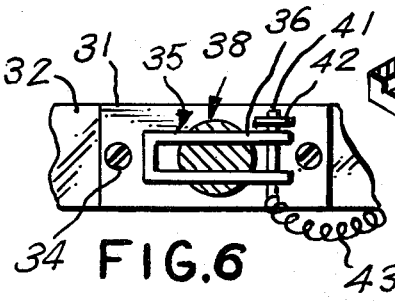
FIG. 6 is an enlarged cross-sectional view, taken along the line 6—6 of FIG. 5.
Figure 7:
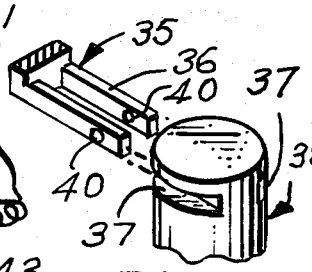
FIG. 7 is an enlarged fragmentary exploded perspective view, of the upper latch member of the mounting plate and rod combination of FIG. 5.
Figure 8:
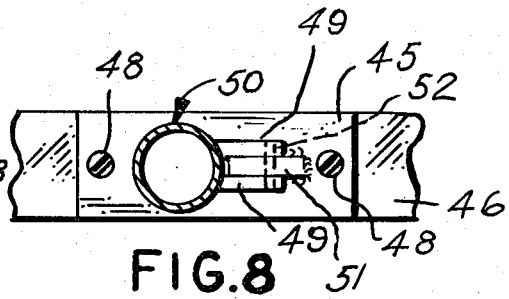
FIG. 8 is an enlarged cross-sectional view taken along the line 8—8 of FIG. 5.
Figure 9:
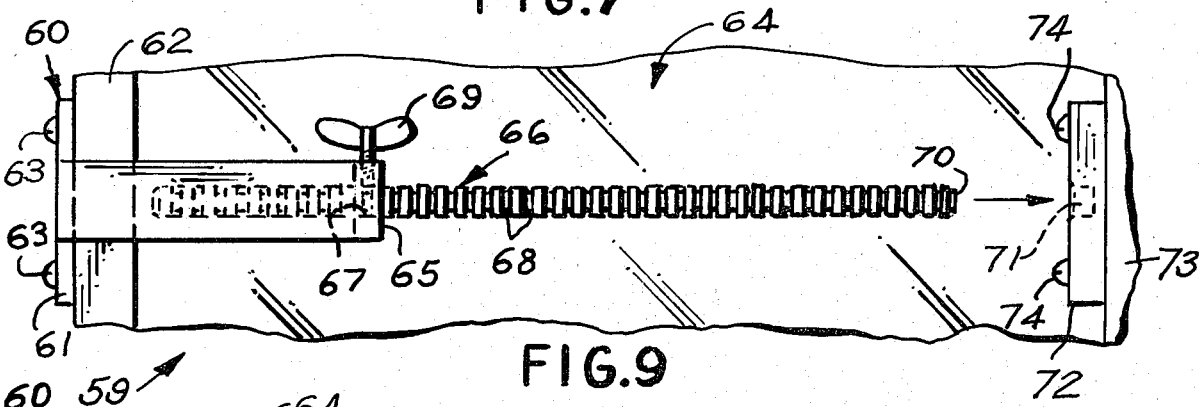
FIG. 9 is a front view of another modified form of the invention, shown mounted to a slide opening window, which is shown fragmentary and in elevation.
Figure 10:
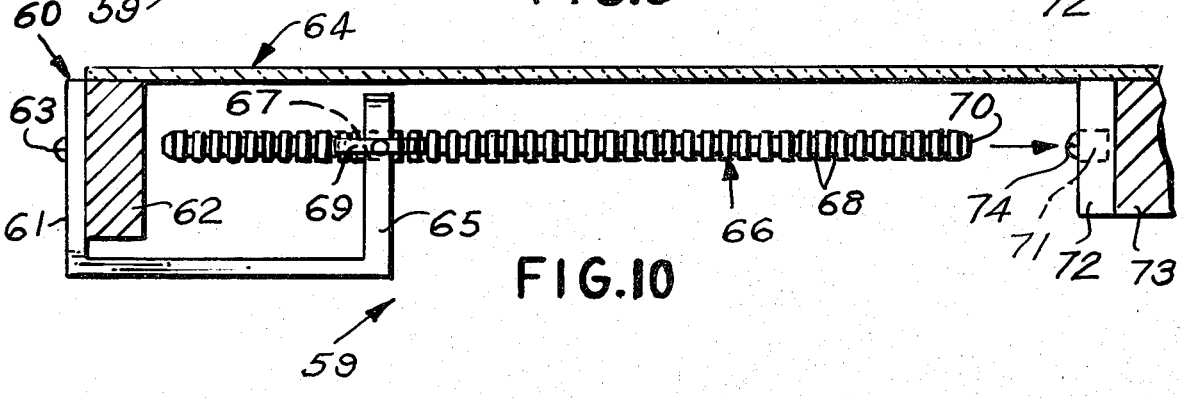
FIG. 10 is a top plan view of FIG. 9.

According to this invention, a window lock 10 is shown to include a top plate 11 of suitable metal, which includes a flanged portion 12, that is fastened, by a pair of suitable screw fasteners 13, to the horizontal top member 14 of window frame 15. An extending lip portion 16, of plate 11, has one end of a rod 17 welded to it, and a plurality of openings or notches 18 align with each other in the longitudinal outer periphery of rod 17, so as to be seated in by the one end of a movable pin 19, for a purpose which hereinafter will be described.

An opening 20, through projection 21 of a bottom plate 22, freely and slidably receives pin 19, which removably engages with any one of the plurality of equally spaced-apart openings 18 of rod 17, and rod 17 is freely and slidably received in opening **17*a* through the flanged portion 23 of plate 22. The flanged portion 23 of bottom plate is secured to the top of the horizontal top member 24 of the bottom window 25, by means of a pair of suitable screw fasteners 26**.

A coil spring **19*a* is freely received on pin 19, within opening 20, and abuts, at one end, with a washer 19*b*, which is fixedly secured to pin 19, in a suitable manner. The opposite end of spring 19*a* urges against washer 19*c*, which is freely received on pin 19, and abuts with end wall 19*d* of projection 21. A "C"-shaped lock washer 19*e* engages with an annular groove (not shown) on pin 19, so as to prevent pin 19 from slipping out of opening 20, before rod 17 is entered into opening 17*a*, during the installation of device 10, and washer 19*e* abuts with end wall 19*d*** on its exterior.

In operation, the ball-shaped end **19*f* is grasped in the fingers of the user, and is pulled outwards, which will release the opposite end of pin 19 from an opening 18 in rod 17, thus enabling the user to raise window 25 to any desired height, such as six inches, after which, pin 19 is released, and the spring 19*a* will automatically urge pin 19 into engagement within the nearest opening 18 of rod 17, thus holding window 25 open until it is desired to close it. To lower window 25, pin 19** is pulled outwards again.

Referring now to FIG. 4, a modified form for use with aluminum windows includes a filler plate 27, of metal or other suitable material, which is placed on top of flanged portion 12 of plate 11, and is freely received within the metal top channel member 28 of window frame 15. A pair of openings 29, through filler plate 27, provides the means, for receiving the fasteners 13, so as to secure plate 11 and plate 27 to aluminum windows.

A modified form of this invention, a lock 30, is shown to include a mounting plate 31, secured to upper horizontal member 32 of window frame 33, by means of suitable screw fasteners 34. A "U"-shaped portion 35, integral with plate 31, includes legs 36, which are removably received in a pair of oppositely opposed slots 37 in the upper end of rod 38, having a plurality of spaced-apart teeth 39, for a purpose which hereinafter will be described. An opening 40, in each of the legs 36, removably receives a clevis pin 41, so as to latch or unlatch portion 35 in slot 37 of rod 38, and a suitable fastener 42 serves as retaining means for clevis pin 41. A suitable chain 43 is secured, at one end, to pin 41, and is secured, at its opposite end, to fastener 44, which is firmly received in horizontal top member 32 of window frame 33. A mounting plate 45 is secured to horizontal member 46 of lower window 47, by means of suitable fasteners 48, and a pair of spaced-apart lugs 49 are fixedly secured, in a suitable manner, to the lower end of sleeve 50. A projection 51, welded to plate 45, is received between lugs 49, and a pivot pin 52 secures lugs 49 and projection 51 together. A lever 53 includes a projection 54, that is removably received in an opening in the wall of sleeve 50, and lever 53 is mounted, by pivot pin 54, to mounting lug 55, that is fixedly secured to the outer periphery of sleeve 50, that telescopingly receives rod 38. A pin 56, welded to the outer periphery of sleeve 50, rides in slot means (not shown) in lever 53, and a coil spring 57, received on pin 56, urges against lever 53 at one end, and urges against sleeve 50 at its opposite end, so as to keep projection 54 within its opening (not shown) in sleeve 50. Lever 53 also includes an off-set handle grip portion 58, for elevating or lowering lower window 47.

In use, clevis pin 41 is normally in place in portion 35, which will render telescoping rod 38 secure in plate 31, unless it is desired to open window 47 almost fully. When the aforementioned is desired, pin 41 is removed from the opening 40 of portion 35, and the sleeve 50 and its rod 38 may be pivoted downwards, as shown in phantom, in FIG. 5 of the drawing. When the lower window 47 is in its full lowered position, the lowermost end of rod 38 is in engagement with projection 54, that extends into the sleeve 50. When it is desired to raise lower window 47, handle grip 58 is urged towards sleeve 50 by the user, which will pivot lever 53, and disengage projection 54 from the end of rod 38. When the aforementioned is accomplished, the user then lifts window 47 to the desired elevation, and releases his grip of lever 53, and the spring 57 will force the projection 54 into the teeth 39, which will keep the window 47 in the desired raised position of approximately six inches.

It shall be noted, that lock 30 may be adapted to fit various size windows, by cutting the rod 38 to the necessary length.

Another modified form of lock 59, "for horizontally slidable windows," is shown to include a mounting plate 60, of "U"-shaped configuration, which is secured, at leg portion 61, to vertical window member 62 of slidable window 64. The opposite leg portion 65, of plate 60, freely and slidably receives a rod 66 within an opening 67, and rod 66 is provided with a plurality of equally spaced-apart annular grooves 68, for receiving the end of wing nut bolt 69. The end 70 of rod 66 is removably received in oval-shaped opening 71 of mounting plate 72, which is secured to window frame 73, by means of suitable screw fasteners 74.

It shall be noted, that opening 71 is oval-shaped, so as to enable rod 66 to have a forty-five degree angle slide into place within opening 71.

In use, lock 59 is placed on windows having a fixed glass in the middle, and rod 66 is positioned to the proper length in opening 67 of plate 60, so as to enable window 59 to be opened only to a desired distance, which will allow for air circulation, and the opening is such, that it will not enable a burglar to enter.

Once the rod 66 is set, the winged bolt 69 is tightened, and the end thereof is in engagement with the nearest groove 68. When window 64 is slid open, the end 70 of rod 66 enters opening 71 of plate 72, which serves as stop means, against any further travel of window 64.

It shall be noted, that plate 60 may be put on the opposite side also, so as to enable both end panels to slide open to a locked position.

It shall also be recognized, that locks 10, 30 and 59 will also save the user money on the cost of electricity, and with the heretofore described windows opened six inches, and locked, no intruder will fit the opening, so as to come in and steal.

While various changes may be made in the detail construction, it is understood that such changes will be within the spirit and scope of the present invention, as is defined by the appended claims.

What I now claim is:

1. An energy saving lock, comprising, in combination, a lower mounting plate, secured to the upper horizontal member of the lower window of a pair, a sleeve secured pivotally to said lower mounting plate, a toothed rod telescopingly received in said sleeve, a hand lever pivotally received on said sleeve, for engaging said toothed rod, and an upper mounting plate secured to the upper horizontal member of the window frame, for removably receiving the free end of said toothed rod.

2. An energy saving lock, according to claim 1, said lower plate being secured to the top of said upper horizontal member of said lower window, by suitable screw fasteners, a lug fixedly secured to the top of said lower plate by suitable means, a pair of projections fixedly secured to the outer periphery of the lower end of said sleeve, said lug being received between said projections, a pivot pin received in openings of said projections and said lug, providing pivot means for said sleeve, a third projection fixedly secured to the outer periphery of said sleeve near its top end, said third projection including a pivot pin received in said hand lever, so as to enable said hand lever to pivot its end projection in and out of an opening included in the wall of said sleeve, and said projection of said lever engages with the teeth of said toothed rod to hold said lower window at any desired elevation, by a coil spring received on a fourth projection, fixedly secured to the outer periphery of said sleeve, said spring urging against said sleeve at one end, and urging against said lever at its opposite end, and said fourth projection is freely received in an opening included in said lever, and said lever is urged against said spring, by the user gripping the handle end and applying pressure, so as to release said projection of said lever from said teeth of said toothed rod.

3. An energy saving lock, according to claim 1, said upper mounting plate being secured to said upper horizontal member of said window frame, by suitable screw fasteners, a "U"-shaped member, fixedly attached to the face of said mounting plate, the legs of which are removably received in a pair of oppositely opposed slots, included in the outer periphery of one end of said toothed rod, a clevis pin removably received in an opening through the end of said legs, for retaining said toothed rod on said legs, and a chain secured to the opposite end of said clevis pin, and to a suitable fastener secured to said upper horizontal member of said window frame, said fastener serving as retaining means for said clevis pin, when said toothed rod is removed from said upper mounting plate, so as to enable said sleeve and said toothed rod to be pivoted downward.

4. An energy saving lock, comprising, in combination, a "U"-shaped mounting plate, secured to a vertical side member of a horizontally slidable window, a grooved rod, freely and slidably received in said "U"-shaped mounting plate, providing adjustable stop means for the distance said slidable window is opened, a winged set screw received in said "U"-shaped mounting plate, for securing said grooved rod at a desired distance in said "U"-shaped mounting plate, a flat mounting plate, secured to a vertical side member of a fixed window frame, said grooved rod being removably received in said flat mounting plate, when said slidable window is opened.

5. An energy saving lock, according to claim 4, said "U"-shaped plate having one leg secured to said vertical side member, by suitable screw fasteners, the opposite leg of said "U"-shaped plate including an opening, in which said grooved rod is freely received, and said set screw is tightened into one of the plurality of annular grooves extending the length of said grooved rod.

6. An energy saving lock, according to claim 5, said flat plate being secured to said vertical side member of said fixed window frame, and the extending end of said grooved rod is removably received in an oval-shaped opening in the front face of said flat plate, and limits the travel of said slidable window, when it is opened.

* * * * *